US006995642B1

(12) United States Patent
Leupold

(10) Patent No.: US 6,995,642 B1
(45) Date of Patent: Feb. 7, 2006

(54) STRUCTURES PRODUCING A MAGNETIC FIELD WITH A GRADIENT AND A PLANAR-SPHERICAL MAGNETIC FIELD SOURCE

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/193,985

(22) Filed: Jul. 28, 2005

Related U.S. Application Data

(62) Division of application No. 10/644,566, filed on Aug. 19, 2003.

(51) Int. Cl.
*H01F 7/02* (2006.01)

(52) U.S. Cl. ..... 335/306

(58) Field of Classification Search ..... 335/302–306
See application file for complete search history.

(56) References Cited

U.S. PATENT DOCUMENTS 5,028,903 A * 7/1991 Aubert ..... 335/306
6,579,625 B1 * 6/2003 Engel et al. ..... 428/611

* cited by examiner

*Primary Examiner*—Ramon M. Barrera
(74) *Attorney, Agent, or Firm*—Michael Zelenka; George B. Tereschuk

(57) ABSTRACT

Magnetic field structures composed of stacked magnetic laminae that are magnetically oriented perpendicular to their planes and configured to cause a volume charge density and cancel the field effects of unwanted surface negative charges are provided. This arrangement causes a uniform volume magnetic charge density, which results in a magnetic field normal to the laminae. The stacked magnetic laminae magnetic field structures cancel the field effects of the deleterious unwanted surface charges because these surface charges are so situated that their contributions to the internal magnetic field mutually cancel each other, and thus they are no longer detrimental to the magnetic field created by the volume charge density.

One embodiment provides a planar-spherical magnetic field gradient source structure.

8 Claims, 4 Drawing Sheets

STRUCTURES PRODUCING A MAGNETIC FIELD WITH A GRADIENT AND A PLANAR-SPHERICAL MAGNETIC FIELD SOURCE

DIVISIONAL APPLICATION

This application is a divisional application of U.S. patent application Ser. No. 10/644,566, entitled, "Structures Producing A Magnetic Field With A Gradient," which was filed on Aug. 19, 2003. A patent based on that Parent application is about to be granted. That Parent application was filed by the inventor herein, is currently pending before the U.S. Patent Office and, under 35 USC § 120, is "an application similarly entitled to the benefit of the filing date of the first application." This divisional application is being filed under 35 USC § 120, 35 USC § 121 and 37 CFR § 1.53 (b), and priority from the Aug. 19, 2003 effective date of the Parent application (Ser. No. 10/644,566) is hereby claimed.

GOVERNMENT INTEREST

The invention described herein may be manufactured, used, imported, sold, and licensed by or for the Government of the United States of America without the payment to me of any royalty thereon.

FIELD OF THE INVENTION

The present invention relates generally to permanent magnetic field sources, and more particularly to magnetic structures that are field gradient sources.

BACKGROUND OF THE INVENTION

There is a continuing demand for strong magnetic fields of thousands of gauss with large gradients of thousands of gauss per centimeter for mechanical device applications such as activators, mechanical bearings and magnetic separators, as well as electromagnetic applications including partial beam experiments, microwave radiation sources, mm-wave radiation sources, free electron lasers and so on. A major difficulty in magnetic design is the lack of the free electronic charge used in electrical designs. In magnetics, every magnetic positive charge, e.g. north magnetic pole, is always accompanied by an equal and opposite negative charge in the south magnetic pole. Whenever a specific charge distribution is needed to configure a desired magnetic field, the negative counterparts of the required charges need to be rendered minimally deleterious to the desired magnetic field. Further, prior art techniques for producing a magnetic field gradient such as producing a field-taper normal to the direction of the field lines, an axial taper in the remanences of the magic cylinders, or a longitudinal taper, are considered inadequate and ineffective because they are complex, expensive and time-consuming. Prior art magnetic structures are unable to effectively minimize the deleterious effects of the unwanted counterparts of required charges. Thus, there has been a long-felt need for simple and inexpensive magnetic field gradient sources that produce a strong volume charge density using layered structures that can cancel unwanted surface charges. This invention's magnetic field gradient source structures can produce the long-sought volume charge density in a number of inexpensive and relatively simple layered arrangements that cancel unwanted surface charges, without suffering from the disadvantages, limitations and shortcomings of prior art magnetic structures.

The magnetic structures of the present invention overcome the shortcomings and limitations of minimizing unwanted negative charges with a layered, or laminated, arrangement of magnets configured so that the unwanted negative charges are mutually cancelled by other parts of the structure. The field gradient sources of the present invention comprise a series of stacked magnetic laminae that are magnetically oriented perpendicular to their planes in a number of configurations. The magnetic structure of the present invention makes it possible to fulfill the long-felt need for a simple and inexpensive way of providing a field gradient source that does not suffer from the disadvantages, limitations and shortcomings of complex, expensive and time-consuming prior art high magnetic field devices. As used herein, the terms "lamina" and "laminae" are defined as any thin plate, sheet or layer.

SUMMARY OF THE INVENTION

It is an object of this invention to provide simple and inexpensive field gradient sources.

It is another object of this invention to provide a flat-layered magnetic structure as a field gradient source.

It is still another object of this invention to provide a layered magnetic cylinder composed of magnetic laminae that are magnetically oriented perpendicular to their planes as a field gradient source.

It is yet another object of this invention to provide layered magnetic spheres composed of magnetic laminae that are magnetically oriented perpendicular to their planes as field gradient sources.

It is still a further object of this invention to provide methods for providing a field gradient source based on a layered magnetic structure composed of magnetic laminae that are magnetically oriented perpendicular to their planes.

These and other objects and advantages are accomplished with the present invention providing magnetic field structures comprising stacked magnetic laminae that are magnetically oriented perpendicular to their planes and configured so that a volume charge density is provided and the field effects of unwanted surface negative charges are cancelled. These objects and advantages are accomplished by arranging stacked thin magnetic laminae into various configurations where each of the magnetic laminae is thinner than the radius of that particular layer and the magnetic strength, M(r), of each layer will vary linearly with the normal distance (r) from the stack's center based on the equation:

$$M(r) = \frac{M(t)}{t} r \tag{1}$$

where t is the half-thickness of the stack. Such an arrangement causes a uniform volume magnetic charge density, ρ, which results in a magnetic field normal to the laminae of the magnitude, M. One important advantage of this invention's stacked magnetic laminae magnetic field structures is to cancel the field effects of the deleterious unwanted surface charges because these surface charges are so situated that their contributions to the internal magnetic field mutually cancel each other, and thus they are no longer detrimental to the magnetic field created by the volume charge density. Additionally, working spaces to use the internal magnetic field can be made with radial tunnels, meridional slots and so forth.

One embodiment of the present invention provides a planar magnetic field gradient source structure. Other embodiments provide a series of nested spherical magnetic shells, a layered magnetic cylinder and several layered magnetic spheres. It is also within the contemplation of the present invention to provide methods for generating magnetic field gradient sources based on a layered magnetic structure composed of magnetic laminae that are magnetically oriented perpendicular to their planes. The present invention's advantageous arrangements of stacked circular magnetic laminae fulfills the long-felt need for a simple and inexpensive way of providing a field gradient source, without suffering from the disadvantages, limitations and shortcomings of prior art magnetic structures.

DETAILED DESCRIPTION OF THE DRAWINGS

Figure 1:
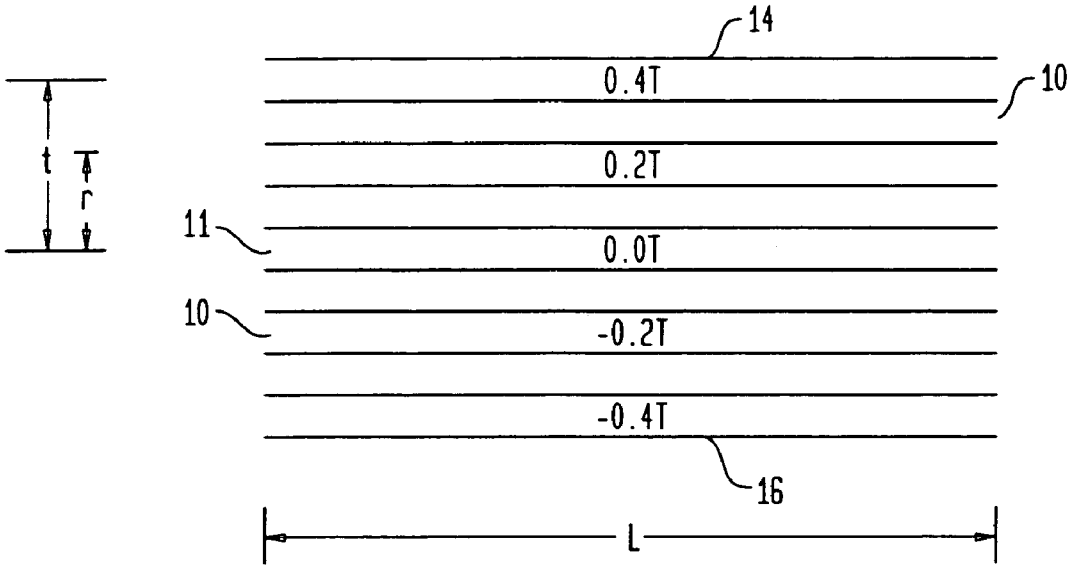
FIG. 1 is a side schematic view of a planar magnetic field gradient source composed of magnetic laminae illustrating varying levels of magnetic intensity in accordance with the present invention.

FIG. 1 is a side schematic view of a planar magnetic field gradient source 15 comprising a layered array of stacked magnetic laminae 10 having a longitudinal length, L, that is large when compared to stack thickness, t. In this embodiment, a group of magnetic laminae 10 are stacked to form a planar magnetic field gradient source 15. The magnetization of magnetic laminae 10 is made to be proportional to the distance r from the stack center 11 in a perpendicular direction from the stack center 11 to provide them with a perpendicular magnetic orientation. The stacked magnetic laminae 10 are much thinner than the radius of each layer and the magnetic strength, M(r), of each layer varies linearly with the normal distance, r, from the stack center 11 according to formula (1) given above, where T is the magnetic field intensity measured in Tesla's. FIG. 1 also depicts representative half-distances from the stack center 11 such as 0.2 T, which indicates magnetic intensity as a function of distance from stack center 11. Such an arrangement gives rise to a volume magnetic charge density, ρ, as given by the following expressions:

$$\rho = -\text{divergence of } \overline{M}(r) = -\overline{\nabla}\cdot\overline{M}(r) \tag{2}$$

$$\rho = -\vec{\nabla}\cdot\vec{M}(r) = -\frac{\partial M(r)}{\partial r} = -\frac{\partial}{\partial r}\left[\frac{M(t)}{t}\right]r \tag{3}$$

$$\rho = -\frac{M(t)}{t} \tag{4}$$

where M(t) is the magnetization of the stack at t and M=M(t)r/t, which is formula (1) given above. A quasi-uniform volume magnetic charge density, ρ, is present throughout the entire planar magnetic field gradient source 15. This volume magnetic charge density is described as quasi-uniform because the change in magnetization is not continuous, but rather varies abruptly from one lamina 10 to another. However, by making the laminae 10 sufficiently thin, as compared to thickness, t, it is possible to approximate uniform density as closely as is necessary.

The magnetic field, H (r), anywhere within one lamina 10 varies according to the following equation:

$$H(r) = 2\pi\rho\cdot 2r = 4\pi\rho r \tag{5}$$

but so that $$\rho = \frac{M(t)}{t} = -\frac{B_r(t)}{4\pi(t)} \tag{6}$$

$$H(r) = -\frac{B_r(t)}{t} \tag{7}$$

$$\text{where } B_r(t) = 4\pi\ M_r(t) \tag{8}$$

is the magnetic remanence of the magnetic material used and M(t) is the maximum magnetization in the stack of the planar magnetic field gradient source 15. The now unpaired negative charges 14 and 16 are found on the two surfaces and cancel each other's effects on the magnetic field as the two surfaces act in opposition with equal strength. By using commercially available material with the greatest $B_r$ of about 14 kG, and constructing a magnetic structure where t=5 cm., the maximum field would be 14 kG just inside the surface. Numerous variations to the planar magnetic field gradient source 15 are possible, such as the volume magnetic charge density, ρ, varying abruptly from one of the magnetic laminae 10 to another or positioning a tunnel through the planar magnetic field gradient source 15 as a working space and the laminae 10 being disks.

Figure 2A:
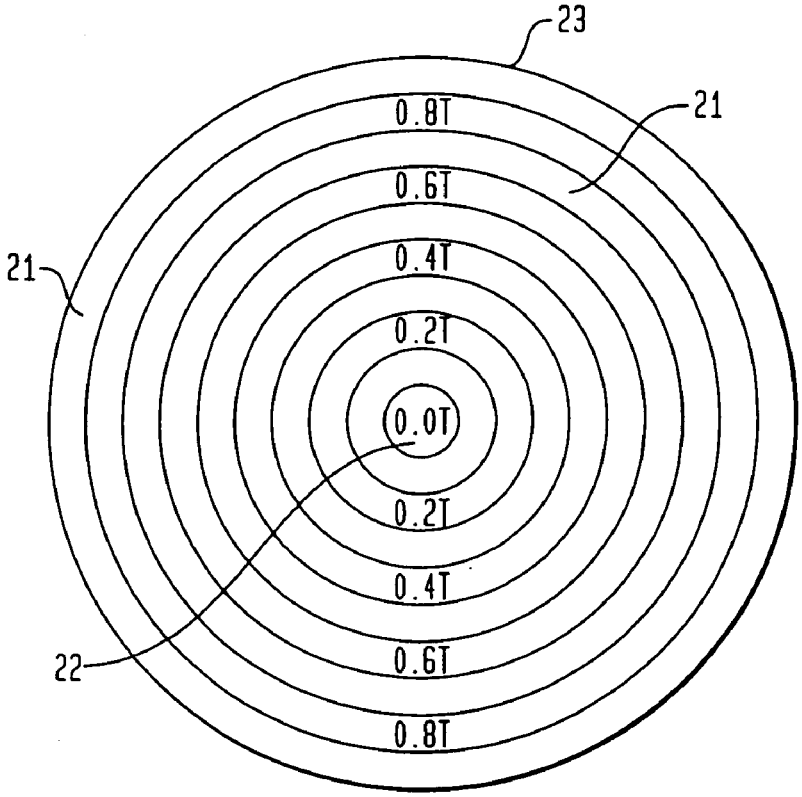
FIG. 2A is a cross sectional view of a cylindrical magnetic field gradient source composed of nested concentric spherical magnetic laminae in accordance with the present invention.
Figure 2B:
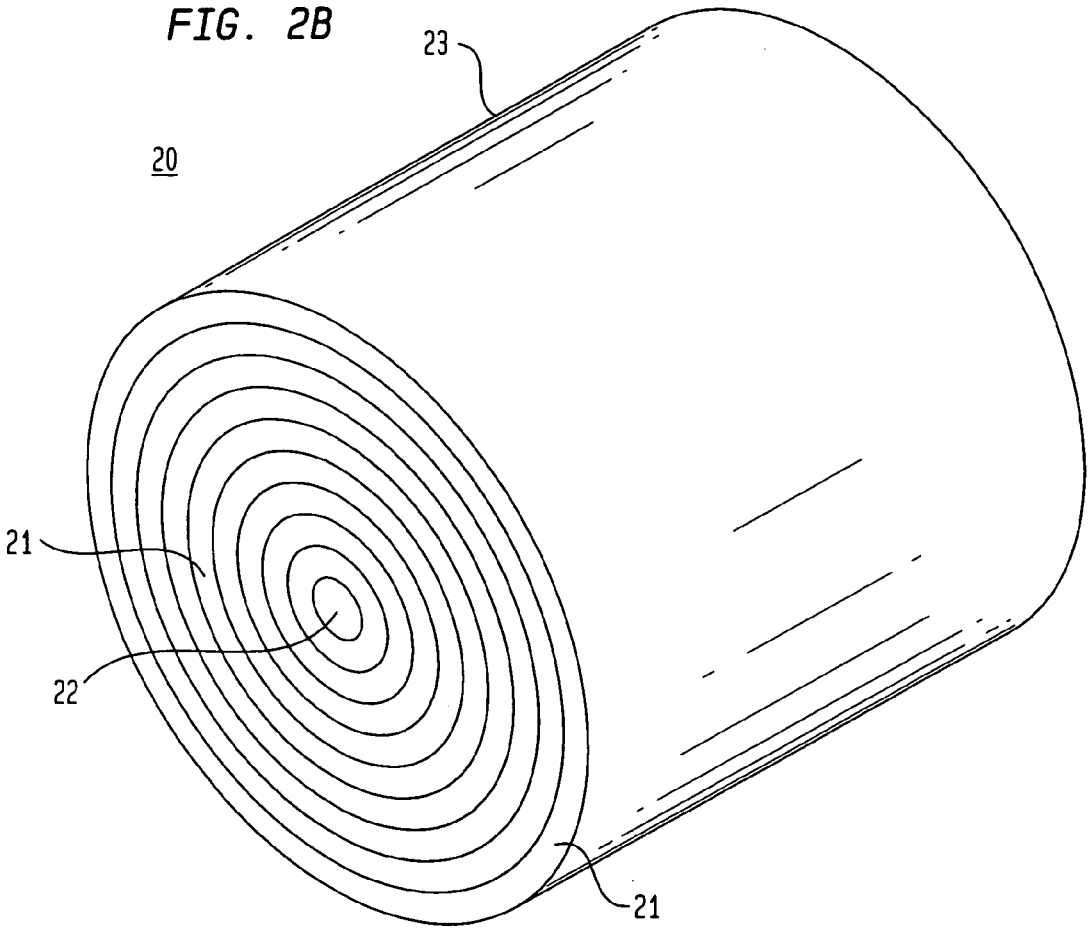
FIG. 2B is a perspective side view of the FIG. 2A cylindrical magnetic field gradient source composed of nested concentric spherical magnetic laminae in accordance with the present invention.

Another embodiment of this invention's magnetic field gradient source is a cylindrical field gradient source composed of nested cylindrical magnetic laminae as depicted in FIGS. 2A and 2B. Referring now to FIG. 2A, there is depicted a cross sectional side view of a cylindrical field gradient source 20, comprising a plurality of nested cylindrical magnetic laminae 21 arranged around a center 22 along with a surface charge 23. The magnetic strength, M(r) of each nested cylindrical magnetic laminae 21 varies linearly with the radial distance from the center 22 with the magnetic field intensity measured in Tesla's. Similar to the first embodiment's planar magnetic field gradient source, this arrangement gives rise to a volume magnetic charge density, ρ.

FIG. 2B is a perspective view of the nested cylindrical magnetic laminae embodiment that also depicts a uniform surface charge 23, which has no effect on the interior field. In this cylindrical field gradient source 20, the magnetization is perpendicular to the magnetic laminae 21 and varies linearly with distance from the center 22 based on the following equations:

$$\rho = \frac{1}{r}\frac{\partial}{\partial r}(M_r^2) \tag{9}$$

$$\rho = \frac{2M}{t} \tag{10}$$

The field within radius r in a cylinder arises from the charge per unit axial length within r, as λ is given by the following equation:

$$\lambda = \pi_r^2\rho = \pi_r^2\left(\frac{2M(t)}{t}\right) \tag{11}$$

Since the charges outside of r have no effect on the field H at r, H is given by vector $\overline{M}$ in polar coordinates having the following magnitude:

$$H = \frac{2\lambda}{r} = \frac{4\pi_r^2 M(t)}{tr} \tag{12}$$

so that:

$$H = \frac{4\pi M(t)r}{t} \tag{13}$$

Therefore, the magnetic field in a cylinder is given by the formula:

$$H = \frac{B_r^r}{t} \tag{14}$$

which is the same linear dependence on distance from the center 22 that is exhibited by the FIG. 1 planar magnetic field gradient magnetic laminae. The surface charge 23 plays no role in this arrangement since the field interior to a uniformly charged cylindrical surface is zero. Other variations of the cylindrical field gradient source 20 embodiment such as the volume magnetic charge density, ρ, varying abruptly from one the of nested cylindrical magnetic laminae 21 to another, positioning a tunnel through cylindrical field gradient source 20 as a working space, or positioning the tunnel to intersect the center are also within the contemplation of this invention.

Figure 3A:
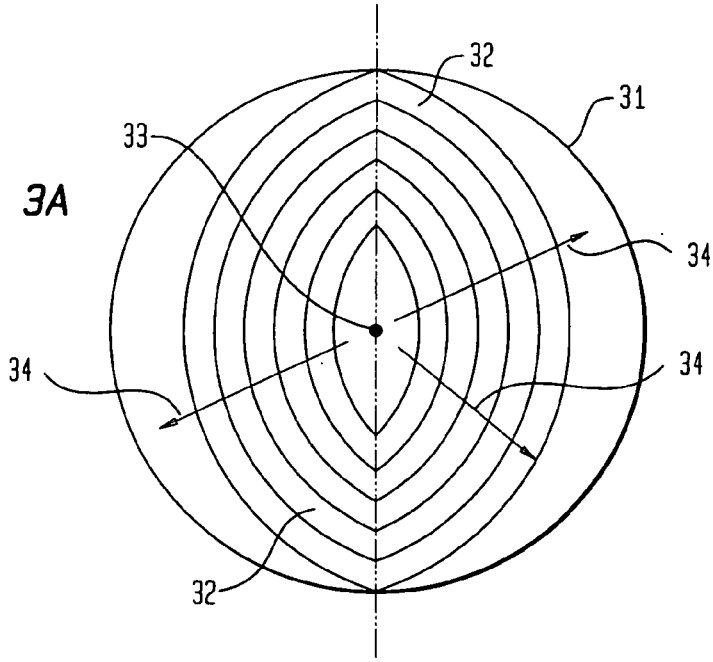
FIG. 3A is a partial cut-away frontal view of a spherical magnetic field gradient source comprising a layered magnetic sphere illustrating an array of nested spherical magnetic laminae in accordance with the present invention.
Figure 3B:
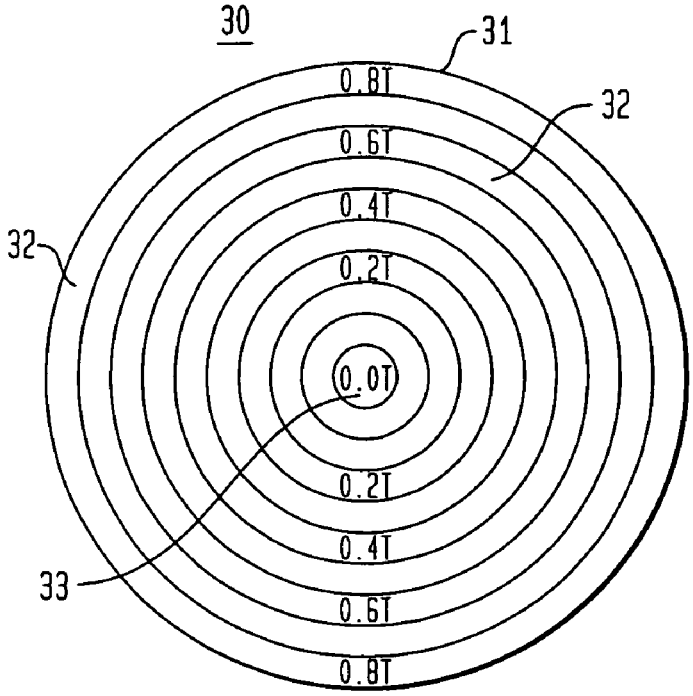
FIG. 3B is an equatorial cross-sectional side view of the FIG. 3A spherical magnetic field gradient source composed of array of nested spherical magnetic laminae in accordance with the present invention.

FIG. 3A is partial cut-away frontal view of a spherical field gradient source 30 comprising a layered magnetic sphere 31 having nested concentric magnetized laminae 32 in accordance with the present invention. The removed cutaway section reveals the concentric magnetized laminae 32 nested within one another. In this case, arrows 34 indicate that magnetization is perpendicular to the radial direction everywhere. As in the other embodiments, the magnetization of each magnetized laminae 32 varies linearly with distance from the center 33. FIG. 3B is an equatorial cross-sectional side view of the spherical field gradient source 30 depicting the magnetic sphere 31 composed of concentric magnetic laminae 32 and the center 33. In this embodiment, the magnetic sphere could also be composed of magnetic shells. The same linear field dependence on distance from the center of the sphere prevails when using the same linear dependence of magnetization distance, as for the cylindrical and planar structures as follows:

$$\rho = -\frac{1}{r^2}\frac{\partial(M_r^2)}{\partial r} \tag{15}$$

$$\rho = -\frac{1}{r^2} - \frac{M^t r^3}{t} \tag{16}$$

$$\rho = -\frac{{}^3M^{(t)}}{t} \tag{17}$$

The volume within r is given by:

$$V_{(r)} = \frac{4\pi r^3}{3} \quad \text{and} \tag{18}$$

$$H = \frac{Q(r)}{r^2} = -\frac{\rho V_{(r)}}{r^2} = \frac{3M_{(t)}}{{}^t r^2}\cdot\frac{4\pi r^3}{3} \tag{19}$$

where Q is the total charge within r.

$$H = \frac{4\pi M^{(t)}r}{t} \tag{20}$$

Thus, the same linear dependence of field applies for all of the laminar structures of the present invention: planar, cylindrical and spherical. Similarly, variations to the other embodiments of this invention, such as the volume magnetic charge density, p, varying abruptly, positioning a tunnel through the magnetic field gradient source as a working space, or positioning the tunnel to intersect the center are also within the contemplation of this invention.

Having discussed the magnetization gradients in the direction of the magnetization itself, one should also consider those cases where magnetization is taken to be the opposite of its gradient. In cases where magnetization is taken to be the opposite of its gradient, the magnetic field will be given by the expression:

$$H = \pm\left[B_r^{(t)} - \frac{B_r^{(t)}}{t}r\right] \tag{21}$$

In a particle beam application, such an arrangement will draw dipolar particles inward to trap them in elliptical paths, whereas when the magnetic field and the gradient are aligned, the particles will be ejected outward because the dipolar particles tend to align themselves with the magnetic field and are drawn in the direction of an increasing field magnitude.

Figure 4:
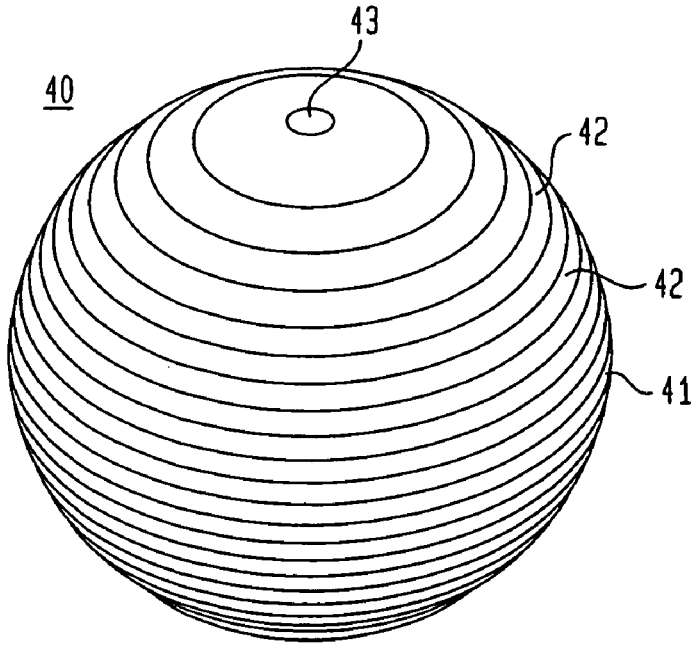
FIG. 4 is a perspective side view of a planar spherical magnetic field gradient source composed of horizontal magnetic laminae with an axial tunnel in accordance with the present invention.
Figure 6:
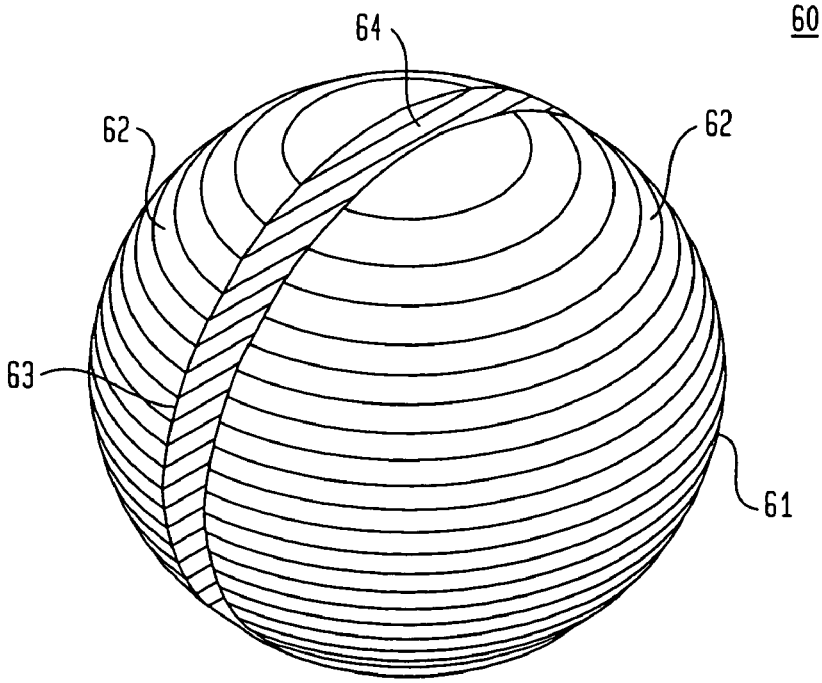
FIG. 6 is a schematic side view of a spherical magnetic field gradient source composed of horizontal magnetic laminae and a meridional slot in accordance with the present invention.

FIG. 4 is a perspective side view of a layered spherical field gradient source 40 composed of stacked planar magnetic laminae and an axial tunnel. The layered spherical field gradient source 40 comprises a layered sphere 41 composed of horizontally stacked flat magnetized laminae 42 of slightly varying sizes in order to provide a spherical shape. Similarly, variations to the other embodiments of this invention, such as the volume magnetic charge density, ρ, varying abruptly, positioning a tunnel through the magnetic field gradient source as a working space, or positioning the tunnel to intersect the center are also apply here. The layered sphere 41 also includes a vertical axial tunnel 43 which can be used as a working space. FIG. 6 depicts a similar layered arrangement with a different working space.

Figure 5:
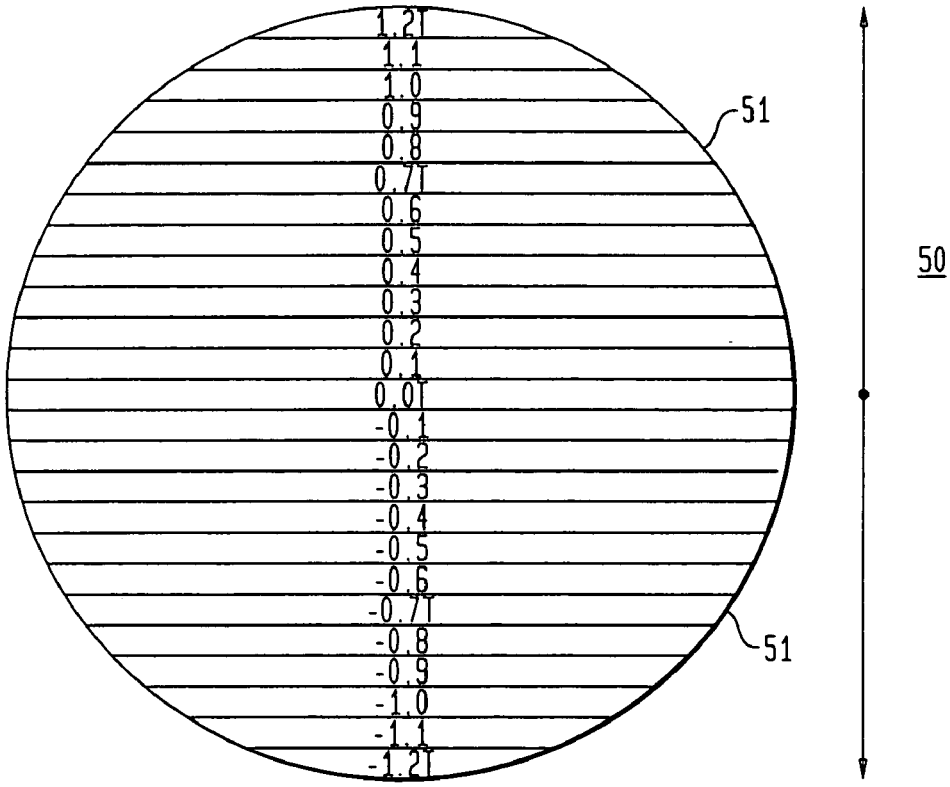
FIG. 5 is a cross sectional side view of a spherical magnetic field gradient source composed of planar laminae that illustrates varying levels of magnetic intensity among the flat magnetized planar laminae in accordance with the present invention.

FIG. 5 is a cross sectional side view of a planar spherical field gradient source 50 composed of horizontally stacked flat magnetized laminae 51 in accordance with the present invention that illustrates varying levels of magnetic intensity among the magnetic laminae. The planar magnetic laminae 51 are magnetized in the same way as the magnetized laminae 10 of the FIG. 1 flat-layered field gradient source 15. In this planar spherical configuration, the volume charge density, ρ, will be the same as that found in the magnetic laminae 10 of the flat-layered field gradient source 15, except that the surface charge distribution no longer cancels the unwanted surface charge, but does produce a field detrimental to that produced by the volume charge density. In this case, the field dependence of distance from the center is still linear in an axial tunnel, but is reduced in both magnitude and gradient. The magnetic field will also lose its symmetry so that the field dependence along any axis passing through the center. Similar limitations also apply to the cylindrical field gradient source.

FIG. 6 depicts a field gradient source 60 comprising a layered sphere 61 composed of a plurality of horizontally stacked flat magnetized laminae 62, each having a slot 63. The slots 63 of the horizontally stacked flat magnetized laminae 42 are aligned to provide a meridional slot 64 as a working space for the entire layered sphere 61. Referring back to FIG. 4 now, the thin vertical axial tunnel 43 in the field direction of horizontally stacked planar magnetized laminae gradient source 40 in that embodiment will provide an empty working space in which the magnetic fields for the structure can be effectively used. Similar working spaces can be formed through any diameter for the cylindrical or spherical field gradient sources. These working spaces can also be formed from planar slots perpendicular to the boundary planes of the disk or meridional slots for the cylindrical and spherical field gradient sources 20, 40 and 60, respectively. The variations to the other embodiments of this invention, such as the volume magnetic charge density, ρ, varying abruptly, positioning a tunnel through the magnetic field gradient source as a working space, or positioning the tunnel to intersect the center also apply here.

Referring back to FIG. 1, the present invention also encompasses methods of generating a magnetic field gradient . . . variations that apply to the planar, cylindrical and spherical magnetic field gradient structures also apply to the methods for generating a magnetic field gradient with planar, cylindrical and spherical structures.

It is to be understood that such other features and modifications to the foregoing detailed description are within the contemplation of the invention, which is not limited by this description. As will be further appreciated by those skilled in the art, any number of configurations, as well any number of combinations of circuits, differing materials and dimensions can achieve the results described herein. Accordingly, the present invention should not be limited by the foregoing description, but only by the appended claims.

The invention claimed is:

1. A planar spherical magnetic field gradient source structure comprising:

a plurality of planar magnetic laminae are stacked in a layered magnetic sphere;

said planar layered magnetic sphere having an outer surface, a pair of opposing poles, a radial dimension, t, and a center;

each of said plurality of planar magnetic laminae being thinner than a spherical radius and having a magnetic charge distribution, a perpendicular magnetic orientation and a variable magnetic strength, M(r);

said planar layered magnetic sphere being configured to cancel unpaired negative surface charges generated by said outer surface;

said variable magnetic strength, M(r), varies linearly with a normal distance, r, from said center;

a working space within said structure;

said perpendicular magnetic orientation and said variable magnetic strength, M(r), generating a uniform volume magnetic charge density, ρ, for said planar layered magnetic sphere, a magnetic field, M, perpendicular to said planar layered magnetic sphere, a maximum spherical magnetization, M(t), and a magnetic gradient with a linear dependence of magnetic field; and said uniform volume magnetic charge density, ρ, varying abruptly from a one of said plurality of planar magnetic laminae to another one of said plurality of plurality of planar magnetic laminae.

2. The planar spherical magnetic field gradient source structure, as recited in claim 1, further comprising:

a tunnel positioned through said structure intersects said center;

said tunnel being said working space; and said perpendicular magnetic orientation being perpendicular to said plurality of planar magnetic laminae.

3. The planar spherical magnetic field gradient source structure, as recited in claim 2, further comprising an opposite direction magnetization opposite said magnetic gradient having a magnetic field given by the equation:

$$H = \pm\left[B_r^{(t)} - \frac{B_r^{(t)}}{t}r\right]$$

where said H is the magnetic field and said $B_r^{(t)}$ is the magnetic remanence of the magnetic material used to construct said structure.

4. The planar spherical magnetic field gradient source structure, as recited in claim 3, further comprising said plurality of planar magnetic laminae being disks.

5. The spherical planar magnetic field gradient source structure, as recited in claim 1, further comprising each of said plurality of planar magnetic laminae having a slot.

6. The spherical planar magnetic field gradient source structure, as recited in claim 5, further comprising said plurality of planar magnetic laminae being aligned to form a meridional slot.

7. The planar spherical magnetic field gradient source structure, as recited in claim 6, further comprising said meridional slot being said working space.

8. The spherical planar magnetic field gradient source structure, as recited in claim 7, further comprising positioning said meridional slot perpendicular to said plurality of planar magnetic laminae.

* * * * *